US005987852A

United States Patent [19]

Bozich et al.

[11] Patent Number: 5,987,852

[45] Date of Patent: Nov. 23, 1999

[54] METHOD FOR THE TACK-FREE PACKAGING OF A HOT-MELT PRESSURE SENSITIVE ADHESIVE

[75] Inventors: Frank Bozich, Oak Brook; Charles James King, Wooddale, both of Ill.

[73] Assignee: Croda Adhesives, Inc., Itasca, Ill.

[21] Appl. No.: 09/024,947

[22] Filed: Feb. 17, 1998

[51] Int. Cl.[6] ..... B65B 63/08

[52] U.S. Cl. ..... 53/440; 53/450

[58] Field of Search ..... 53/440, 450, 122, 53/127, 553

[56] References Cited

U.S. PATENT DOCUMENTS

| | | | |
|---|---|---|---|
| 2,616,232 | 11/1952 | Meyer | 53/450 |
| 2,759,308 | 8/1956 | Nawrocki | 53/122 |
| 3,481,283 | 12/1969 | Vogt | 53/122 |
| 3,851,438 | 12/1974 | Brisman | 53/440 X |
| 5,715,654 | 2/1998 | Taylor et al. | 53/440 |
| 5,804,610 | 9/1998 | Hamer et al. | 53/440 X |
| 5,806,285 | 9/1998 | Rizzieri | 53/440 X |
| 5,819,505 | 10/1998 | Fayolle et al. | 53/440 |

*Primary Examiner*—Linda Johnson
*Attorney, Agent, or Firm*—McAndrews, Held & Malloy, Ltd.; Donald J. Pochopien

[57] ABSTRACT

The present invention is directed to a method for the high throughput tack-free packaging of a hot-melt thermoplastic or thermosetting pressure sensitive adhesive composition. The method provides for the conveyorized packaging of a continuous stream of a molten hot-melt adhesive composition in a non-tack thermoplastic film wherein the stream is converted into two or more rows of tack-free packaged hot-melt blocks.

20 Claims, 2 Drawing Sheets

METHOD FOR THE TACK-FREE PACKAGING OF A HOT-MELT PRESSURE SENSITIVE ADHESIVE

BACKGROUND OF THE INVENTION

A. Field of the Invention

The present invention is directed to a method for packaging hot-melt pressure sensitive adhesive compositions. In particular, the present method is directed to a method for the high throughput tack-free packaging of a thermoplastic or thermosetting hot-melt pressure sensitive adhesive composition, wherein the packaging is both tack-free and compatible with the adhesive composition in the molten state. The present invention is useful because it provides a clean and convenient method to handle the otherwise tacky hot-melt adhesive composition and eliminates the waste typically associated with its packaging.

B. Background

Hot-melt, pressure sensitive adhesive compositions are typically applied while in the molten or liquid state. However, at room temperature, they are generally solids and they are sold to the industry in the form of blocks. However, the solid block are so tacky that if untreated, they would stick to hands, each other, dirt and anything else that they contacted. Accordingly, various methods have been developed to provide for the low-tack or tack-free handling of hot-melt adhesive compositions.

A variety of methods employ a tack-less micronized powder that is dusted on the outer surface of the hot-melt, pressure sensitive adhesive as it cools. Moreover, they need to be applied at the appropriate temperature. A problem with these micronized powders is that they are expensive to make and thus, costly to use.

U.S. Pat. No. 4,748,796, which issued Oct. 22, 1988, and U.S. Pat. No. 4,755,245, which issued Jul. 5, 1988, disclose a method for powder coating a hot-melt, pressure sensitive adhesive composition by electrostatically coating a mold or cavity with a powder, pouring the hot-melt adhesive into the powder coated mold, and then dusting the top of the hot-melt in the mold cavity.

U.S. Pat. No. 5,333,439 discloses coating a micronized powder for the release packaging of a hot-melt pressure sensitive adhesive composition in a siliconized plastic film.

Other methods pour the hot-melt, pressure sensitive adhesive into molds that are sprayed with a film of non self-sticking hot-melt material. Still other methods squeeze the molten hot-melt, pressure sensitive adhesive as an inner layer surrounded by a molten outer layer of a compatible non-tacky polymer. Such methods are expensive because they require separate vats of molten materials. The latter method is particularly expensive to operate because it requires a specialized piece of equipment with precisely controlled flows to completely envelop the hot-melt in molten non-tack polymer.

U.S. Pat. Nos. 5,373,682 and 5,392,592 disclose a method for the vertical packaging a hot-melt, pressure sensitive adhesive by extruding the molten hot-melt down into a continuous cylindrical tube of plastic film that is liquid cooled on the outside to keep the molten hot-melt from melting through. The plastic film is selected to be meltable with the adhesive composition and blendable therein. To form appropriate sized cartridges or tubes of adhesive, the plastic film containing the molten adhesive is squeezed with voider rolls, which crimp the packaging while cooling the molten adhesive at the crimped end. The '592 patent discloses crimping the ends and holding them closed with a meltable plastic wire. The resulting product resembles a series of sausage links hanging end to end. A problem with these methods is that the output of each machine is relatively slow, since each machine has a single nozzle that is only capable of extruding a single cartridge or tube of adhesive at a time. Moreover, the output is limited by the time it takes each chilled voided roll to crimp and cool the ends of each segment of adhesive before release.

U.S. Pat. No. 5,387,623 discloses a method for the waste-free packaging of hot-melt adhesive composition in a biodegradable polymeric packaging material. In the '623 patent, the biodegradable packaging is meltable in the adhesive without adhesive effect. The method of the '623 patent is very slow because it requires providing an individual portion of the hot-melt adhesive composition and solidifying the individual portion before packaging it.

Accordingly, an object of the present invention is to provide a method for the high throughput packaging of a hot-melt adhesive composition in a tack-free manner, wherein the packaging is meltable therein without adverse effect.

SUMMARY OF THE INVENTION

The present invention is directed to a method for the high throughput continuous production of a packaged hot-melt adhesive composition, wherein the packaging is compatible with the hot-melt composition and is blendable therein without adverse affect. More particularly, the present invention is directed to a method for the continuous packaging of a hot-melt adhesive composition comprising the steps of:

a) providing a thin film of a first thermoplastic material onto the surface of a cooled moving belt;

b) providing a molten hot-melt adhesive composition onto the thermoplastic film on said belt;

c) providing a thin layer of a second thermoplastic material on top of the molten hot-melt adhesive composition such that the molten hot-melt adhesive is sandwiched between the first and second thermoplastic materials;

d) compressing the sandwiched hot-melt to the desired thickness with a first cooled surface, and providing a first series of substantially continuous seams in the conveyorized and sandwiched hot-melt composition, wherein in the seams, the second thermoplastic material is in a sealed contact with the first thermoplastic material; and e) compressing a second series of seams into the sandwiched hot-melt adhesive, the first and second series of seams in combination providing a continuous series of isolated bricks of the hot-melt adhesive composition packaged between said first and second thermoplastic materials.

DETAILED DESCRIPTION OF THE INVENTION

Figure 1:
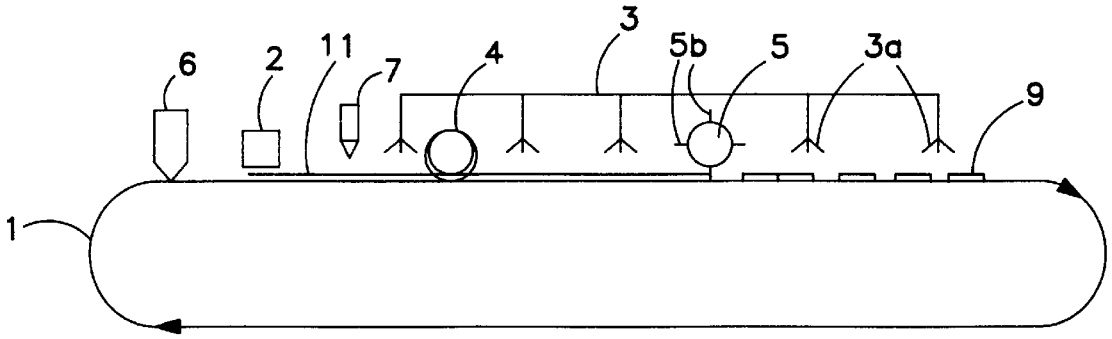
FIG. 1 discloses a conveyorized belt for the high throughput and continuous packaging of a hot-melt adhesive composition in one embodiment of the invention, wherein the first thermoplastic layer and the second thermoplastic layer are extruded, and the FIG. 2 discloses a conveyorized belt for the high throughput and continuous packaging of a hot-melt adhesive composition in a second embodiment of the invention, wherein the first thermoplastic layer and a second thermoplastic layer are unrolled as a film.

The present invention is directed to a method for the high throughput and continuous production of a tack-free packaged hot-melt adhesive composition wherein the packaging is compatible with the hot-melt composition and is blendable therein without adverse effect. The method of the present invention is capable of being practiced in any one of several embodiments. In its broadest aspect, the present invention is directed to a method for the continuous packaging of a hot-melt adhesive composition comprising the steps of:

a) providing a thin film of a first thermoplastic material onto the surface of a cooled moving belt;

b) providing a molten hot-melt adhesive composition onto the thermoplastic film on the belt;

c) providing a thin layer of a second thermoplastic material on top of the molten hot-melt adhesive composition such that the molten hot-melt adhesive is sandwiched between the first and second thermoplastic materials;

d) compressing the sandwiched hot-melt to the desired thickness with a first cooled surface, and providing a first series of substantially continuous seams in the conveyorized and sandwiched hot-melt composition, wherein in the seams, the second thermoplastic material is in a sealed contact with the first thermoplastic material; and e) compressing a second series of seams into the sandwiched hot-melt adhesive, the first and second series of seams in combination providing a continuous series of isolated bricks of the hot-melt adhesive composition packaged between said first and second thermoplastic materials.

In the above method, the first thermoplastic material and the second thermoplastic material are provided as a layer or a film by extrusion, pouring, dispensing or by being unrolled as needed or by any combination of extrusion, pouring, dispensing and unrolling.

The first thermoplastic layer and the second thermoplastic layer are tack-free thermoplastics that may be same or different. When they are the same, the second thermoplastic layer is preferably thicker than the first thermoplastic layer because it needs to be able to be stretched without tearing so as to form a seam with the first thermoplastic layer. This is accomplished by any compression baffle but preferably by one or more pattern forming rollers having such baffles.

The melting point of the first and second thermoplastic materials should be near or preferably lower than the melting point of the hot-melt adhesive in order to provide a satisfactory melting in the melt pot. Accordingly, in the method of the present invention, it is preferred that the conveyorized belt onto which the first thermoplastic material is placed be cooled. The cooling prevents the molten hot-melt adhesive from melting through the first thermoplastic material, particularly, when the first thermoplastic material is a thin film. Typically, this is accomplished with a cooled, continuous, conveyor belt. Preferred conveyor belts are made of stainless steel, which renders them relatively inert to the films or adhesives and resistant to oxidation. Such continuous, cooled conveyor belts are commercially available from manufacturers, such as Sandvik Process Systems, Totowa, N.J., or from Berndorf Belt Systems, U.S.A., Schaumburg, Ill.

The method of the present invention is adaptable to the packaging of virtually any type of hot-melt adhesive composition. It is especially adapted to the packaging of thermoplastic or thermosetting pressure sensitive adhesives where the handling problems are most severe. As examples, the method disclosed herein may be used to package hot-melt adhesives prepared from polymers and copolymers of synthetic resins, rubbers, polyethylene, polypropylene, polyurethane, acrylics, vinyl acetate, ethylene vinyl acetate and polyvinyl alcohol. More specific examples include hot-melt adhesives prepared from the following:

a. rubber polymers such as block copolymers of monovinyl aromatic hydrocarbons and conjugated diene, e.g., styrene-butadiene, styrene-butadiene-styrene, styrene-isoprene-styrene, styrene-ethylene-butylene-styrene and styrene-ethylene propylene-styrene.

b. ethylene-vinyl acetate polymers, other ethylene esters and copolymers, e.g., ethylene methacrylate, ethylene n-butyl acrylate and ethylene acrylic acid;

c. polyolefms such as polyethylene and polypropylene;

d. polyvinyl acetate and random copolymers thereof;

e. polyacrylates;

f. polyamides;

g. polyesters;

h. polyvinyl alcohols and copolymers thereof;

i. polyurethanes;

j. polystyrenes;

k. polyepoxides;

l. graft copolymers of vinyl monomer(s) and polyalkylene oxide polymers; and m. aldehyde containing resins such as phenol-aldehyde, urea-aldehyde, melamine-aldehyde and the like.

Preferred copolymers are styrene-butadiene-styrene, styrene-isoprene-styrene and ethylene vinyl acetate.

Most often such adhesives are formulated with tackifying resins in order to improve adhesion and introduce tack into the adhesive. Such resins include, among other materials, (a) natural and modified resins, (b) polyterpene resins, (c) phenolic modified hydrocarbon resins, (d) coumarone-indene resins, (e) aliphatic and aromatic petroleum hydrocarbon resins, (f) phthalate esters and (g) hydrogenated hydrocarbons, hydrogenated rosins and hydrogenated rosin esters.

Desirable optional ingredients include diluents, e.g., liquid polybutene or polypropylene, petroleum waxes such as paraffin and microcrystalline waxes, polyethylene greases, hydrogenated animal, fish and vegetable fats, mineral oil and synthetic waxes as well as hydrocarbon oils such as naphthionic or paraffmic mineral oils.

Other optional additives may include stabilizers, antioxidants, colorants and fillers. The selection of components and amounts as well as the preparation thereof are well known in the art and described in the literature.

The first and second thermoplastic films may be any film which is meltable together with the adhesive composition and blendable into the molten adhesive and which will not deleteriously affect the properties of the adhesive composition when blended therewith. Suitable thermoplastic materials include ethylene based polymers such as ethylene-vinyl acetate, ethylene acrylate, ethylene methacrylate, ethylene methyl acrylate, ethylene methyl methacrylate, high and low density polyethylene, polyethylene blends and chemically modified polyethylene, copolymers of ethylene and C 1–6 mono- or diunsaturated monomers, polyamides, polybutadiene rubber, polyesters such as polyethylene terphthalate, polybutylene terephthalate, etc.; thermoplastic polycarbonates, atactic poly-alpha-olefins, including atactic polypropylene; thermoplastic polyacrylamides, polyacrylonitrile, copolymers of acrylonitrile and other monomers such as butadiene, styrene, etc., polymethyl pentene, polyphenylene sulfide, aromatic polyurethanes, styrene-acrylonitrile, acrylonitrile-butadiene-styrene (ABS), styrene-butadiene rubbers, polyethylene terphthalate, acrylonitrile-butadiene-styrene (ABS) elastomers, polyphenylene sulfide as well as polyvinyl aromatic-rubber block copolymers.

The films may, if desired, contain antioxidants for enhanced stability as well as other optional components such as fatty amides or other processing aids, anti-status, stabilizers, plasticizers, dyes, perfumes, fillers and the like.

The specific thermoplastic film utilized will depend, in large part, on the composition and melting point of the hot-melt adhesive being packed with the softening point of the film generally being less than about 125° C. Particularly preferred for most hot-melt adhesives are thermoplastic films of low density polyethylene or ethylene vinyl acetate (EVA) wherein the amount of vinyl acetate is 0 to 10%, preferably 3 to 5%, by weight. Especially preferred are such films having a melt flow index of 0.5 to 10.0; a softening point of 100° C. to 120° C. and a specific gravity of 0.88 to 0.96. One example of these films is an EVA film which is commercially available from Armin Polyfilm under the ARMIN 501 tradename. For best results in reprocessing, it is preferred that the specific gravity of the packaging film be the same as or less than the specific gravity of the molten hot-melt adhesive.

The thickness of the film utilized generally varies between about 0.1 mil to 6 mil, preferably 0.5 mil to 4 mil. The thickness of the particular film also varies depending upon the temperature at which the molten adhesive is pumped or poured into the plastic film cylinder. As a general rule, thinner films are capable of being used as the first thermoplastic film since it is against the cooled surface of the conveyor and is not subject to any physical stresses. The thicker films are preferred for use as the second thermoplastic film since they need sufficient material to be able to stretch when subjected to the pattern surfaces, preferably pattern rollers, in the method of the present invention.

The particular viscosity at which the adhesive can be introduced into the plastic film cylinder will vary depending on a variety of factors including the pumping capacity of the pump, the strength of the plastic film and the like. Viscosities in the range of 500 to 250,000 cps, preferably 2,000 to 100,000 may be utilized. Preferably, the viscosity is between 10,000 and 50,000 cps. The temperature at which an adhesive composition will exhibit this viscosity range will vary from one adhesive to another.

It is further preferred that the thermoplastic film comprise not more than about 1.5% by weight of the total adhesive mass, and preferably not more than 0.2 to 1.0% by weight of the mass in order to prevent undue dilution of the adhesive's properties.

The cooled conveyor which is important to the success of the method of the present invention may be made of any material which will effectively and rapidly remove or absorb the excess heat from the entire surface of the film which is in contact with the molten hot-melt adhesive composition so as to prevent the temperature of the film from exceeding its melting point even though the molten hot-melt adhesive temperature is higher than the film melting temperature. Suitable cooling is provided by spraying the undersurface of the conveyor belt with cooled water or other refrigerant such as chilled glycol, liquid or gaseous nitrogen, compressed carbon dioxide or the like. The spraying may be accomplished, for example, using a series of spray nozzles aimed at the undersurface of the conveyor belts.

In one embodiment, the process of the present invention employs a moving (conveyorized) stainless steel belt that has bottom cooling capabilities. These belts have long been utilized in the industry to process tack-free adhesives. However, they have been impossible to use for processing tacky products, particularly hot-melts, because the products stick to the belt making it impossible to remove. The present method employs a tack-free thermoplastic material that is applied to the conveyor belt, either as an unrolled film, or as an extruded, dispensed, sprayed or poured film or layer thereon. Preferably, the first thermoplastic material is applied as an unrolled film. The molten hot-melt adhesive that is to be packaged is then poured, dispensed or extruded thereon. The conveyorized hot-melt adhesive then moves downstream where while still molten, and encounters a compatible second tack-free thermoplastic material that is applied thereon, either as an unrolled film, or as a film or as a layer extruded thereon. Cooling of the top film of thermoplastic material is optional, depending upon the melting point and the viscosity of the adhesive being packaged. Before adhesive has solidified, two or more cooled surfaces, preferably pattern rollers, are placed on top of the second thermoplastic material causing it to be pushed against the first thermoplastic material and the cooled belt beneath. One of the cooled surfaces compresses the sandwiched hot-melt adhesive to the desired thickness. Then, in any order, the two cooled surfaces press a series of crossing sealed seams (channels) into the sandwiched adhesive. Preferably, the first chilled surface is a pattern roller having a series of parallel fins (or baffles) that compress the second thermoplastic film to the first thermoplastic film and cause a continuous seal to be formed in the conveyorized and sandwiched hot-melt adhesive that passes thereunder. By employing a series of parallel baffles, fins or wheels on the roller, a series of parallel seams (i.e., channels) are formed in the belt direction in the conveyorized hot melt adhesive composition. The second cooled surface is preferably a cooled, pattern roller having a plurality of baffles or fms running along its length, across the belt direction. These baffles or fins are deeper than the depth of extruded adhesive and push the second thermoplastic material (i.e., the top layer) down until it touches the bottom layer (or film) and the chilled belt underneath. This contact forms a sealed seam in the cross-belt direction, and results in the production of a series of individually packaged adhesive packs (or bricks) connected to one another by the belt direction and cross belt direction seams. At the end of the cooling belt, these seams are cut, causing the isolated bricks of the hot-melt adhesive to be sealed in individual tack-free packages that are compatible with the adhesives intended use. At this time, the adhesive inside the packs can still be molten as long as the core temperature is not great enough to soften the seals.

The use of the cooling belt allows the system to be run faster and at higher temperatures and increases productivity. The present method allows the production of various sizes of the packaged adhesive simply by adjusting the height and/or size of the rollers, and the size of their baffles (or fins).

FIG. 1 discloses an apparatus for practicing one embodiment of method of the present invention. In particular, FIG. 1 disclose a cooled conveyor 1, shown as moving in the clockwise direction. Above the horizontal surface of the conveyor 1 is an extruder head 6 which dispenses or extrudes a tackless thermoplastic layer or film (not shown)

onto the moving surface of the conveyor below. Downstream from the first extruder head 6 is a head 2 for dispensing, extruding or pouring the hot-melt adhesive composition of interest 11 onto the conveyorized film below. Downstream from the head 2 for the hot-melt adhesive is a third extruder head 7 for dispensing or extruding on top of the extruded hot-melt adhesive a second thermoplastic layer which may be the same or different than the first thermoplastic layer such that the hot-melt adhesive is sandwiched between the first and second thermoplastic layers. A cooled first pattern roller 4 compresses the sandwiched molten adhesive to a predetermined thickness between the first and second thermoplastic layers. The pattern roller 4 also has a plurality of disk-like vertical fins (or baffles) extending therefrom (not shown), running parallel to each other and circumscribing the roller for compressing the second thermoplastic layer down to the first thermoplastic layer and to the cooled conveyor such that a seam is formed in a continuous straight line as the sandwiched and conveyorized hot-melt passes thereunder. The edge (not shown) of the vertical fins (or baffles) on the cooled pattern roller 4 should be sufficiently flat or rounded so as to compress the second thermoplastic layer without cutting it. Upon passing under the first pattern roller, a series of parallel seams are produced in the sandwiched hot-melt adhesive that generate a plurality of parallel logs of hot-melt adhesive isolated between each pair of seams. A cooling device 3 dispenses cool air or spray 3*a* to further harden the extruded hot-melt adhesive and the second thermoplastic layer. A second cooled pattern roller 5 has a plurality of fins 5*a* projecting along the length of the roller 5, such that when the roller spins, the fins compress the second thermoplastic layer onto the first thermoplastic layer such that the molten inner surface of the second thermoplastic layer meets and seals upon being cooled by the cooled roller. The result is a series of seams in the sandwiched adhesive that run across the width of the conveyor, and that when combined with the lengthwise parallel seams of the first pattern roller produce a plurality of parallel bricks 9 of a hot-melt adhesive composition that are completely sealed in a tack-less packaging that is meltable in the hot-melt adhesive composition and blendable therein without adverse effect. The seams between the sealed bricks are then cut (not shown) to release the individually sealed bricks of the hot-melt adhesive.

Figure 2:
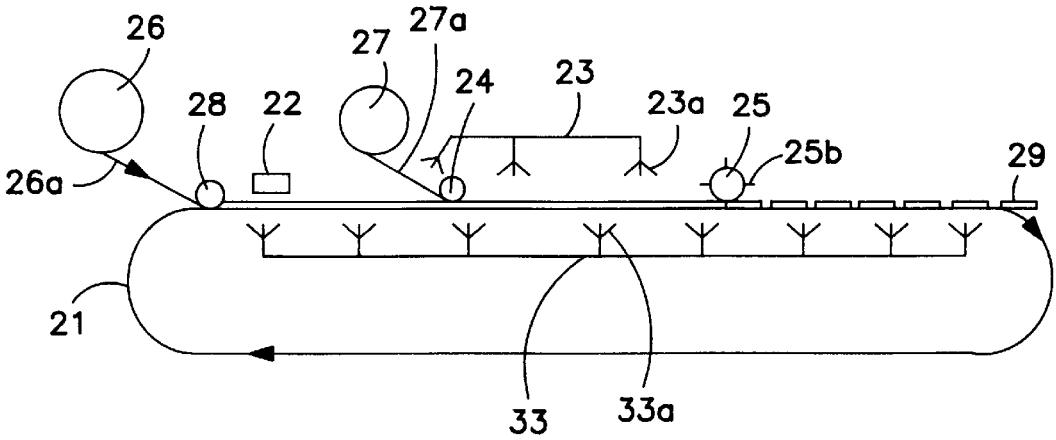

Although FIGS. 1 and 2 provide two different embodiments, it is understood that the various components of the two figures could be switched or combined so as to produce yet other embodiments such as where the first thermoplastic material is extruded, whereas the second is unrolled as a film, or wherein the first thermoplastic material is unrolled as a film and the second thermoplastic material is extruded. Also, the placement and use of the cooling heads may vary depending upon the temperature of the adhesive, the melting point of the adhesive or the thermoplastic layers, or the thickness of the adhesive bricks being produced.

FIG. 2 discloses a variation on the apparatus of FIG. 1 that is used to practice a second and preferred embodiment of the method of the present invention. In FIG. 2, a continuous cooled conveyor 21 is shown running in a clockwise direction. A cooling device 33 cools the underside of the conveyor 21 by dispensing a cooling liquid or spray 33*a*. A first thermoplastic film 26*a* is dispensed from a roll of film 26 and pressed against the cooled surface of the conveyor 21 by a roller 28. A head 22 dispenses, extrudes, or pours the hot-melt adhesive composition onto the first thermoplastic film as it is transported along the continuously moving and cooled conveyor surface (not shown). A second thermoplastic film 27*a*, which may be the same or different than the first thermoplastic film, is dispensed from a roll 27 onto the top of the hot-melt adhesive composition such that it is synchronized with the speed of the conveyor. A first cooled pattern roller 24 firmly presses the first thermoplastic film 26*a* and the second thermoplastic film 27*a* against opposing faces of the hot-melt adhesive composition, and compress the sandwiched hot-melt adhesive to a predetermined thickness. The first cooled pattern roller 24 has a plurality of vertical disk-like baffles, fins or wheels (not shown) extending therefrom, parallel to each other and circumscribing the roller. These vertical fins, wheels or baffles (not shown) continuously compress the inner surface of the second thermoplastic film onto the inner surface of the first thermoplastic film as the sandwiched and conveyorized hot-melt passes thereunder. As in FIG. 1, the edge of the vertical fins, baffles or wheels should be sufficiently rounded or flat so as to compress the second thermoplastic film down to and in contact with the first thermoplastic film without cutting through it. When the conveyorized and sandwiched hot-melt adhesive passes under this first pattern roller, the continuous series of parallel seams are produced that run in the direction of the conveyor belt and that generate a plurality of parallel logs of hot-melt adhesive isolated between the seams. To assist in hardening the molten hot-melt and to prevent the second thermoplastic film from melting, a cooling device 23 is provided which dispenses a spray or cooling medium 23*a*. Further downstream, there is a second pattern roller 25, having a plurality of fins or baffles 25*a* projecting along the length of the roller 25, such that when the roller spins, the fins compress the second thermoplastic film down to and in contact with the first thermoplastic film, such the molten inner surface of the second thermoplastic film meets and seals upon being cooled by the cooled conveyor. The result is a series of isolated and packaged parallel bricks 29 of a hot-melt adhesive composition that are completely sealed in a tack-less packaging that is meltable in the hot-melt adhesive composition and blendable therein without adverse effect. Because each package of hot-melt adhesive is connected to another along the seam, the seams are optionally cut by the manufacturer or the end user either to fit into a packing box or to provide the desired amount for a melt pot.

Figure 3:
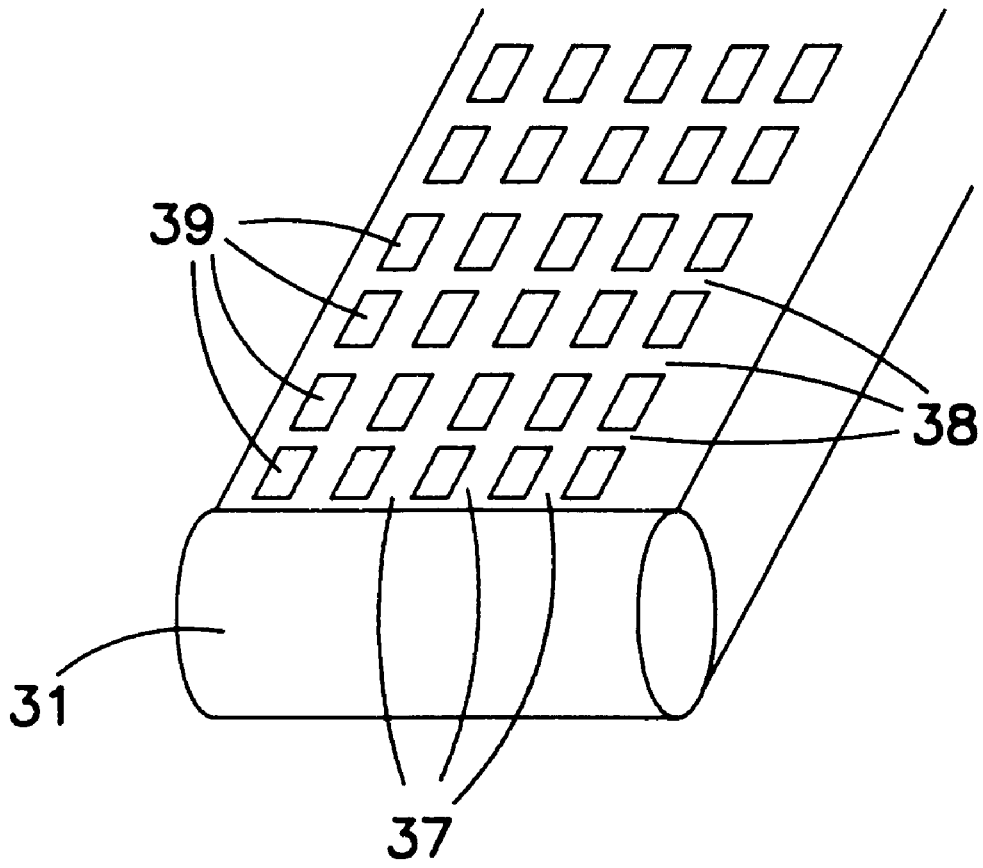
FIG. 3 discloses a frontal view of the conveyorized belt of FIGS. 1 or 2, wherein a plurality of rows (e.g., five rows) of hot-melt adhesive blocks are packaged simultaneously in a tack-free manner.

FIG. 3 is a partial top frontal view of the conveyorized device 31 of the invention, as in FIGS. 1 or 2, showing the plurality of continuous seams 37 as made by the vertical fins (baffles) on the first cooled pattern roller (not shown) and the plurality of crosscut seams 38, as made by the lengthwise fins (baffles) on the second cooled pattern roller (not shown). The result is a plurality of bricks 39 of hot-melt adhesive that are sealed in a tack-less package that is meltable in said hot-melt and blendable therein without any adverse effect.

EXAMPLE

A conventional hot-melt pressure sensitive adhesive was prepared by mixing the following components in parts by weight at melt temperatures:

| | |
|---|---|
| SDS Rubber (Stereon 840 A) | 20 parts |
| USP white mineral oil (Kaydol) | 19.5 parts |
| Antioxidant (Irganox 1010) | 0.5 parts |
| Modified Hydrocarbon Resin (Escorez 5600) | 60 parts |

The resulting molten hot-melt adhesive composition was successfully tested at temperatures ranging from 110° C. to 150° C. using the equipment in the embodiment of FIG. 2 and an ethylene vinyl acetate (EVA) film, ARMIN 501, which is commercially available from Armin Polyfilm). In particular, ARMIN 501 film having a thickness of 4 mil and amp 110° C. was unrolled onto the stainless steel surface of a 48' wide conveyorized cooling belt (Sandvik Process Systems, Totowa, N.J.). The belt was moving at 20 feet/min. The molten hot-melt (at temperatures from 110° C. to 150° C.) was poured onto the ARMIN 501 film in a two foot wide pour. A second roll of ARMIN 501 film (4 mils) was used to provide a second thermoplastic film on top of the hot-melt adhesive composition and to sandwich it therebetween. A first cooled surface compressed the conveyorized hot-melt adhesive to a predetermined thickness between the first and second ARMIN 501 films. The first cooled surface also had a plurality of parallel baffles that compressed the second (top) thermoplastic film (ARMIN 501) down to the first thermoplastic film, each baffle embossing a parallel seam in the hot-melt adhesive in the direction of the belt movement. The seamed and sandwiched hot-melt adhesive was then subjected to a second cooled surface having a baffle that ran across the width of the conveyorized belt and that compressed the second thermoplastic film down to the first thermoplastic film. This second cooled surface was in contact with the compressed hot-melt adhesive for a sufficient time to cause the compressed molten hot-melt to harden or set along the compressed edges. The resulting process simultaneously produced a series of crossed seams that isolated a parallel series of bricks of hot-melt adhesive therebetween, wherein each brick in the series was sealed in a tack-free packaging that was meltable with said hot-melt adhesive composition, blendable therein, and having no adverse effect thereon.

What is claimed is:

1. A method for the continuous packaging of a hot-melt adhesive composition comprising the steps of:

a) providing a thin film of a first thermoplastic material onto the surface of a cooled conveyorized belt;

b) providing a molten hot-melt adhesive composition onto the thermoplastic film on said belt;

c) providing a thin layer of a second thermoplastic material on top of said molten hot-melt adhesive composition such that said molten hot-melt adhesive is sandwiched between said first and second thermoplastic materials;

d) compressing the sandwiched hot-melt to the desired thickness with a first cooled pattern roller, and providing a first series of substantially continuous, parallel seams in said conveyorized and sandwiched hot-melt adhesive composition by a series of fins circumscribing said first cooled pattern roller, where in said seams, said second thermoplastic material is pressed in a sealed contact with said first thermoplastic material; and e) compressing a second series of seams into the sandwiched hot-melt adhesive composition by a second cooled pattern roller, said second series of seams running across the width of said conveyorized belt, said first and second series of seams in combination providing a continuous series of isolated bricks of said hot-melt adhesive composition packaged between said first and second thermoplastic materials.

2. The method of claim 1, wherein said first thermoplastic material and said second thermoplastic material are both a film.

3. The method of claim 2, wherein said first thermoplastic material and said second thermoplastic material are the same thermoplastic material.

4. The method of claim 3, wherein said thermoplastic material is selected from the group consisting of ethylene based polymers, ethylene vinyl acetate, polyamides, polybutadiene rubber, polyesters, polycarbonates, atactic polyalpha-olefins, thermoplastic polyacrylamides, polyacrylonitrile and copolymers thereof, polymethylpentene, polyphenylene sulfide, aromatic polyurethanes, styrene-acrylonitrile, acrylonitrile-butadiene-styrene, styrene-butadiene rubbers, polyethylene terephthalate, polyphenylene sulfide, vinyl aromatic-rubber block copolymers, and styrene-butadiene-styrene rubbers.

5. The method of claim 4, wherein said thermoplastic material is ethylene vinyl acetate or a polyamide.

6. The method of claim 5, wherein said thermoplastic material is ethylene vinyl acetate.

7. The method of claim 2, wherein said second thermoplastic material is thicker than said first thermoplastic material.

8. The method of claim 1, wherein said first thermoplastic material is unrolled as a film onto said belt.

9. The method of claim 1, wherein in step (c) said second thermoplastic material is unrolled as a film onto said molten hot-melt adhesive.

10. The method of claim 1, wherein in step (a) said first thermoplastic material is extruded as a thin film onto the surface of said cooled moving belt.

11. The method of claim 1, wherein in step (c) said second thermoplastic material is extruded onto said molten hot-melt adhesives composition.

12. The method of claim 8, wherein said second thermoplastic material is unrolled as a film onto said hot-melt adhesive composition.

13. The method of claim 10, wherein said second thermoplastic is material is extruded onto said molten hot-melt adhesive composition.

14. The method of any one of claims 1 or 4 wherein said hot-melt adhesive composition is prepared from a polymer and copolymers selected from the group consisting of synthetic resins, rubber blockpolymers, polyethylene, polypropylene, polyurethane, acrylics, vinyl acetate, ethylene vinyl acetate and polyvinyl alcohol.

15. The method of claim 14, wherein said adhesive composition is a rubber block copolymer.

16. The method of claim 15, wherein said rubber block copolymer is a styrene block copolymer selected from the group consisting of styrene-butadiene, styrene-butadiene-styrene, styrene-isoprene-styrene, styrene-ethylene-butylene-styrene, and styrene-ethylene-propylene-styrene.

17. The method of claim 16, wherein said styrene block copolymer is styrene-isoprene styrene or styrene-butadiene-styrene.

18. The method of claim 15, wherein said copolymer is ethylene vinyl acetate.

19. The method of claim 1, wherein said hot-melt adhesive composition has a viscosity of about 500 cps to 250,000 cps.

20. The method of claim 2, wherein said film has a thickness of about 0.1 to 6 mils.

* * * * *